United States Patent [19]

Ohno

[11] 3,931,030

[45] Jan. 6, 1976

[54] ETCHING COMPOSITION FOR ETCHING NICKEL SCREEN ROLLS OR PLATES

[75] Inventor: Yoshio Ohno, Tokyo, Japan

[73] Assignee: Kenseido Kagaku Kogyo Kabushiki Kaisha, Tokyo, Japan

[22] Filed: Oct. 2, 1973

[21] Appl. No.: 402,698

[52] U.S. Cl. ..... 252/79.4; 96/36.3; 156/14; 156/18

[51] Int. Cl.[2] ..... C09K 13/06

[58] Field of Search ..... 252/79.4, 101; 134/3, 41; 156/14, 18; 96/36.3

[56] References Cited

UNITED STATES PATENTS

| | | | |
|---|---|---|---|
| 3,376,228 | 4/1968 | Ruzicka | 252/79.4 |
| 3,412,032 | 11/1968 | Sauquoit | 252/79.4 |
| 3,417,022 | 12/1968 | Sherer | 252/79.4 |
| 3,682,702 | 8/1972 | Hnizda | 134/3 |

*Primary Examiner*—William A. Powell
*Assistant Examiner*—Brian J. Leitten
*Attorney, Agent, or Firm*—Fred Philpitt

[57] ABSTRACT

Delicate and high grade nickel screen rolls or plates for printing are prepared by using corrosion-resistant mother roll and a specified powderless etching composition comprising $HNO_3$, $H_2O_2$, surfactants and an organic solvent.

1 Claim, 6 Drawing Figures

GALVANO PROCESS
PERCENTAGE PERFORATION 9~15%

LACQUER PROCESS
PERCENTAGE PERFORATION 9~15%

ETCHING PROCESS
PERCENTAGE PERFORATION 85~95%

ETCHING COMPOSITION FOR ETCHING NICKEL SCREEN ROLLS OR PLATES

This invention relates to a method for producing nickel screen rolls or plates for printing. More specifically this invention relates to a method for producing nickel screen rolls or plate by polishing and plating a nickel roll or plate, coating the plated roll or plate with a sensitizing resin solution, printing half tone film and images film on the coated rolls or plate, developing the printings, water-washing the developed printings and then etching the exposed nickel by using a specified powderless etching composition and comprising an inorganic acid, hydrogen peroxide and a surfactant and an organic solvent, and also to a powderless etching composition useful in said method.

Recently, it has become a common process to form various complicated shape, figure, pattern or relief by etching. This process is called a powderless etching technique and uses a mixture of a water-soluble acid, a water-insoluble organic solvent and a surfactant. This process is disclosed in U.S. Pat. Nos. 2,640,763, 2,640,767, 2,828,194, 2,743,536, Japanese patent publication Nos. 10315/1959, 26075/63, and 1825/1968, relatively in detail. However, the objective metals of these processes of the patent literatures are zinc, magnesium, or their alloys. It has never been known to use nickel or nickel alloys as the objective.

Recently a rotary screen process in which a nickel roll is used in screen printing has been proposed. The screen rolls used in this process are produced by electro-plating but in forming a complicated shape, figure, or pattern on the screen, two kinds of processes have been used.

One of them is a process called lacquer method and the other is called galvano-method.

Lacquer method comprises steps of surface polishing of a mother roll, engraving the polished surface to give a suitable mesh pattern, plugging an electrically non-conductive resin in the concave parts of the engraved roll, melting the resin by heating, water washing for defatting, nickel plating, drawing the plated nickel layer from the outside of the mother roll to give a nickel cylinder having mesh holes all over the whole surface when it is drawn out, coating a sensitizing solution on the screen roll followed by drying but closing unnecessary hole parts photographically, printing images on the coated rolls, developing and drying.

Galvano-method comprises steps of surface polishing of a mother roll, coating the roll with a sensitizing resin solution, followed by drying, printing of halftone film and image film, developing, water washing, nickel-plating of the exposed metal surface of the roll and drawing out a plated layer from the mother roll.

Since a plating is used in both the methods they have drawbacks in the following points.

1. The thickness of films of a sensitizing resin and non-conductive resin plugged in the engraved parts is in the order of 2 – 4 microns. When a nickel layer is increased to more than 70 micron thickness by plating, the nickel tends to hang over the sensitizing resin and the reproduction of image cannot be carried out with high fidelity.

2. In plating methods, in the inner walls of the hole parts of plated layers, there are formed slopes of about 45° from the top surface to the bottom. This is usually called that there is formed shoulders of about 45° and this means that corresponding amount of plated layers hangs over resin films. On account of this angle of slope, the fineness of screen mesh and thickness of nickel layer are restricted.

3. In plating methods, it is impossible to control the size of holes and as a result, holes must be either wholly closed (100%) or wholly opened (100%). Accordingly, the outlines of patterns do not become sharp.

4. In plating methods, the width of line printed on the surface of a mother roll becomes thicker proportionally with the thickness of nickel plated layer. When a plated layer is 100 micron, it is impossible to make the width of line less than 50 micron.

Accordingly, more delicate and higher grade of plate making becomes impossible in cases of conventional methods.

The above-mentioned drawbacks can be overcome by the method of the present invention in which a nickel roll or a nickel plate is prepared according to a powderless etching process by using an etching composition of the present invention.

The powderless etching is a technique which is opposite to powdering process or dragon's blood process which utilizes powder treatment before etching and has been developed for special metals useful for engraving such as zinc, magnesium, copper, or the like. It is necessary to use different kind of and different concentration of inorganic acid and additive depending upon the difference of metal.

The metal used in the method of the present invention is nickel or a nickel alloy. Since nickel has not been used as a printing plate except as a nickel electroplated plate, there has not been developed etching technique. However, after the development of a screen printing process which uses a rotary screen, the usefulness of nickel has been recognized and after repetition of deliberation and experimentation it has become possible to prepare superior printing rolls or plates according to the etching process of the present invention.

The first requirement of the process of the present invention is the use of an alloy-mother roll or an alloy-plated mother roll which is not corroded in an etching solution and capable of producing a nickel-plated layer undetachable during etching step but easily detachable at the time when the plated nickel screen is drawn out.

For mother rolls of a rotary screen, an iron roll has been used but in the etching solution of the present invention, iron is corroded. Accordingly a stainless steel roll such as SUS-27 (composition; C—less than 0.15%,Cr—17–20%, Ni—9–13%, Mo and Ti trace), SUS-32 (composition; C—less than 0.08%, Cr—16–20%, Ni—10–16% Mo—1.2–4.0%, Ti, etc. trace) etc. or an iron roll whose surface has been subjected to a treatment of incorrodible metal e.g. plating treatment of alloy of nickel or tin must be used in the method of the present invention.

The second requirement of the process of the present invention is an etching condition. The nickel screen roll or plate has been heretofore made through a process which relies on plating and does not utilize etching. However, in the process of the present invention, an etchant containing a suitable proportion of an inorganic acid and hydrogen peroxide and a specified additive is used to make nickel screen roll or plate with a sufficient etching speed.

The present invention thus resides in a process comprising a combination of the first and second requirement.

The etching composition of the present invention is most effectively used in the process of the present invention comprising the above-mentioned first and second requirements in which a surface of an alloy mother roll is polished, plated, coated with a sensitizing resin solution, printed with a halftone film and images film, subjected to development, water washing, and etching and plated roll is drawn out from the mother roll.

The etching composition of the present invention, is, however, also useful in a conventional process comprising polishing and plating the surface of a conventional mother roll, drawing out the plated roll from the mother roll, coating the inside surface of the roll wholly with an acid-resisting paint, inserting the plated roll whose inside surface is coated, onto an etching roll, to give a firm engagement, printing a halftone film and images film thereupon, followed by development, water washing, etching through the second requirement, drawing out of the plated roll from the etching roll and removing the coating of the inside surface.

For carrying out etching an etching solution is splashed vertically upon the nickel plated surface by using a spray or a paddle. However with the etching solution alone, not only the etching of the vertical direction but also that of the lateral direction which is a so-called side-etching takes place, but if the etching composition of the present invention is used, the etching of the vertical direction alone is advanced and the etching of the lateral direction is suppressed, resulting in a screen having a high fidelity to images.

Since the side-etching can be suppressed by the etching composition of the present invention, it is possible to obtain a higher percentage perforation according to the present invention. According to the conventional galvano or lacquer methods, a percentage perforation of only 9 – 15% can be attained, but according to the composition of the present invention, perforation percentage of as high as 85 – 95% can be easily attained.

The present invention will be more fully described by referring to drawings.

FIG. 3 is compared with FIGS. 1 and 2.

Figure 1:
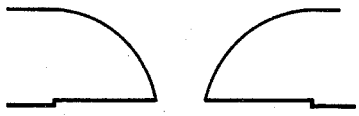
FIG. 1 shows a cross-sectional view of a hole obtained according to a galvano process.
Figure 2:
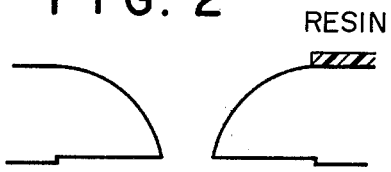
FIG. 2 shows a cross-sectional view of a hole obtained according to a lacquer process.

The etching composition of the present invention comprises (i) an etching solution consisting of 5 – 15% by volume of 62% $HNO_3$, 15 – 25% by volume of 35% hydrogen peroxide, 3 – 6% by volume of additives and a balance of water. The additives comprise 40 – 60% by volume of a film builder, 15 – 25% by volume of a film builder assistant, 4 – 6% by volume of a first etching promoter and 20 – 30% by volume of a second etching promoter.

The film builder is kerosene and organic hydrocarbon solvents incompatible with water and containing 50% or more of aromatic hydrocarbon such as Solvesso 150 (Trade mark for aromatic petroleum solvent applied from Esso Research) or Panasol AN-1 (Trade mark for petroleum aromatic solvent available in a variety of boiling ranges, supplied from Amoco Chemicals).

The film builder assistant is a sulfate salt of glycerides mainly of $C_{18}$ fatty acid, a sulfate salt mainly of $C_{18}$ fatty acid or sulfate salt mainly of $C_{18}$ fatty alcohol.

The first group etching promoter is dioctyl sulfosuccinate salt, sulfonate salt of $C_{10}$ – $C_{12}$ petroleum hydrocarbon, sulfonate or sulfate salt of $C_{10}$ – $C_{12}$ fatty acids or $C_{10}$ – $C_{12}$ fatty alcohols.

The second group etching promoter is butyl carbitol, polyethylene glycol, polypropylene glycol, a mixture of a block copolymer thereof. The above-mentioned sulfate or sulfonate salts are all alkali metal salts, mainly sodium salts.

It is also possible to add 10 mol % or less of nonionic ethylene oxide adduct.

If a film builder of hydrocarbon solvent is used less than 40% by volume of the additive, side etching becomes greater and if it is used greater than 60% by volume of the additive, unevenness of etching takes place.

If a film builder assistant is less than 20% by volume of the additive, side-etching becomes greater and if it is used greater than 30%, etching becomes weaker. If an etching promoter is used less than 20% of the additive, etching becomes weaker and if it is used greater than 30% of the additive, side etching tends to increase. Further in case of smaller amount of additive in general, side etching tends to increase and in case of greater amount of additive in general, etching tends to be weaker.

As alternative for nitric acid, there are hydrochloric, sulfuric acid, etc. and all of them can be used only for the purpose of etching but if the easiness of use, and processability are concerned, nitric acid is advantageous. Hydrochloric acid generates hydrochloric acid gas, and sulfuric acid may be dangerous at the time of dilution with water.

Moreover, they are inferior to nitric acid also in the point of etching speed. The use in an amount of 5 – 15% by volume of 62% nitric acid, preferably about 9 – 10% by volume of 62% nitric acid is suitable.

According to one opinion, hydrogen peroxide serves a function of removing inactive state films of hydrogen ion or nitrous acid in carrying out etching with nitric acid. Accordingly, compounds having an activity same as hydrogen peroxide e.g. such oxidizing agents as ammonium persulfate etc. can be substituted for it but from the easiness of handling simplicity of treatment, and effectiveness per unit weight of additive, hydrogen peroxide is most suitable. It is used in an amount of 15 – 25% by volume of 35% products preferably 18 – 20% by volume of 35% product.

Figure 4:
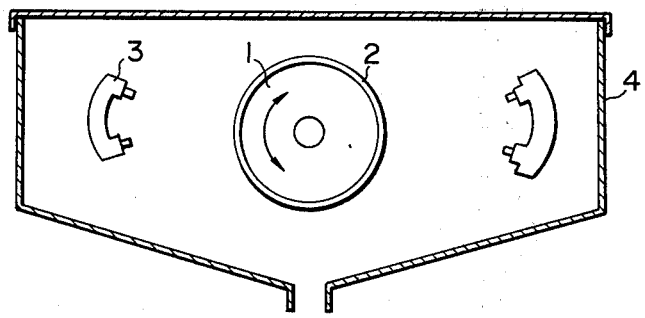
FIG. 4 shows a vertical schematic view of an apparatus for carrying out etching.
Figure 3:
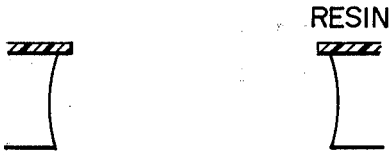
FIG. 3 shows a cross-sectional view of a hole obtained according to a process in which the composition of the present invention is used. The superiority of the perforation percentage of the present invention is seen clearly when
Figure 5:
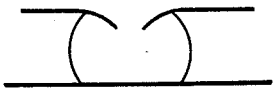
FIG. 5 shows a vertical section of hole obtained according to example 17.
Figure 6:
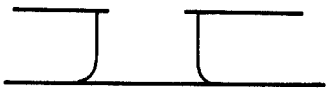
FIG. 6 shows a vertical section of a hole obtained when a steel mother roll is used with a protection coating on the back side.

It is convenient to use an apparatus shown in FIG. 4 for carrying out etching according to the process of the present invention. In this figure, 1 is a mother roll, 2 is a nickel layer, 3 is nozzles for spraying etching composition, 4 is an etching machine. A roll useful for this purpose is made of martensite, ferrite, austenite type stainless steel, an alloy of nickel and tin (35 : 65). Particularly special austenite steel roll, a Ni-Mo-Fe-Cr-alloy roll, a cobalt alloy roll, a precious alloy roll such as rolls of platinum group metal, a plated roll of vanadium group metal, a titanium alloy roll and a titanium roll, etc.

The following examples will further illustrate this invention without limiting its scope.

EXAMPLE 1

A stainless mother roll (SUS 27, circumferential length of 640 mm and length 1000 mm) was immersed in a bath of nickel sulfamate aqueous solution and an electric current was passed through a solution temperature of 50°C and at a rate of 10 A/dm² to give a thickness of 90 – 100 μ. To the nickel surface, 7% by weight polyvinyl cinnamate in 6:4 ethyl acetate:toluene solution was coated to give a 5 – 7μ film by spraying. After drying for 10 minutes, 3:1-100 mesh halftone film was printed by using a Xenon lamp. The image was developed in the solution of 7:3 xylene:ethyl cellosolve acetate to dissolve out unexposed parts, washed with water to produce images.

Thereafter etching was carried out in a known spray type etcher by employing following bath composition

| | |
|---|---|
| Composition A | 2.5 parts by volume |
| 62% $HNO_3$ | 5 parts by volume |
| 35% $H_2O_2$ | 10 parts by volume |
| Water | 35 parts by volume |

The composition A was prepared by sufficiently mixing 100 parts by volume of commercial kerosene (having a KB value greater than 75) as a film builder, 40 parts by volume of sulfonated castor oil (SCO) as a film builder assistant. 10 parts by volume of sodium dioctyl sulfosuccinate (SDOS) and 50 parts by volume of butyl carbitol (BC) as an etching promoter.

As etching condition, a bath temperature of 35°C, and a spray pressure of 0.3 kg/cm² were employed. Etching of pretreated nickel roll was carried out after stirring for about 5 minutes.

The revolutions per minute for the roll was 12 and the direction was reversed after every 30 seconds. Etching time for the roll being plated to the thickness of 100 μ was 40 minutes. For the depth of etching of 100 μ, there was observed a side etching of 20 μ on one side.

EXAMPLE 2

The roll made according the procedure of Example 1 was subjected to etching by using a following bath.

| | |
|---|---|
| Composition B | 2.5 parts by volume |
| 62% $HNO_3$ | 5 parts by volume |
| 35% $H_2O_2$ | 10 parts by volume |
| Water | 35 parts by volume |

The composition B was prepared by sufficiently mixing 100 parts by volume of Solvesso 150 (Esso Standard KB value 75 – 100) as a film builder, 40 parts by volume of sulfated castor oil (SCO) as a film builder assistant, 10 parts by volume of sodium dioctyl sulfosuccinate (SDOS) and 50 parts by volume of butylcarbitol (BC).

By using a bath temperature of 35°C, a spray pressure of 0.3 kg/cm² and a roll revolution of 12 r.p.m., etching was carried out for 30 minutes for a nickel plating of 100 μ thickness. For the depth of 100 μ there was observed in side etching of 20 μ on one side.

EXAMPLES 3 – 17

Several runs of experiments were carried out similarily to Example 1 according to the conditions described in the following tables.

| | | |
|---|---|---|
| PAN | = | Panasol AN-1 |
| SCO | = | Sulfonated castor oil |
| NaDOS | = | Sodium dioctylsulfosuccinate |
| BC | = | Butyl carbitol |
| KB | = | Kauri-Butanol values |

| | Examples | 1 | 2 | 3 | 4 | 5 | 6 | 7 | 8 |
|---|---|---|---|---|---|---|---|---|---|
| | Condition | | | | | | | | |
| Parts by weight of etching solution | 62% $HNO_3$ | 5 | 5 | 5 | 5 | 5 | 5 | 5 | 5 |
| | 35% $H_2O_2$ | 10 | 10 | 10 | 10 | 10 | 10 | 10 | 10 |
| | Water | 35 | 35 | 35 | 35 | 35 | 35 | 35 | 35 |
| | Additive | 2.5 | 2.5 | 2.5 | 2.5 | 2.5 | 2.5 | 2.5 | 2.5 |
| Parts by volume of additive | Film Builder | Kerosene 100 | Solvesso (150) 100 | 11 PAN 100 | PAN 100 | PAN 100 | PAN 100 | PAN 100 | PAN 100 |
| | | SCO 40 | SCO 40 | SCO 40 | Sulfonated oleic acid 40 | Sulfonated sperm oil 40 | Sulfonated olive oil 40 | SCO 40 | SCO 40 |
| | Film Builder Assistant | NaDOS 10 | NaDOS 10 | NaDOS 10 | NaDOS 10 | NaDOS 10 | NaDOS 10 | Petroleum Sulfonate 10 | Lauryl Sulfonate 10 |
| | Etching promoter | BC 50 | BC 50 | BC 50 | BC 50 | BC 50 | BC 50 | BC 50 | BC 50 |
| | Etching (°C) temperature | 35 | 35 | 35 | 35 | 35 | 35 | 35 | 35 |
| | Etching time for 100 μ nickel plating (min) | 40 | 30 | 20 | 25 | 30 | 35 | 40 | 15 |
| | One side etching for 100 μ depth | 20 | 20 | 10 | 5 | 10 | 5 | 5 | 20 |

| | Examples | 9 | 10 | 11 | 12 | 13 | 14 | 15 | 16 | 17 |
|---|---|---|---|---|---|---|---|---|---|---|
| | Condition | | | | | | | | | |
| Parts by weight of etching solution | 62% $HNO_3$ | 5 | 5 | 5 | 5 | 6 | 4 | 5 | 5 | 5 |
| | 35% $H_2O_2$ | 10 | 10 | 10 | 10 | 10 | 10 | 10 | 10 | 10 |
| | Water | 35 | 35 | 35 | 35 | 35 | 35 | 35 | 35 | 35 |
| | Additive | 2.5 | 2.5 | 2.5 | 2.5 | 2.5 | 2.5 | 2.5 | 2.5 | 0 |
| | Film Builder | PAN 100 | PAN 100 | PAN 100 | PAN 100 | PAN 100 | PAN 100 | PAN 100 | PAN 100 | |

-continued

| | Examples | 1 | 2 | 3 | 4 | 5 | 6 | 7 | 8 | |
|---|---|---|---|---|---|---|---|---|---|---|
| Parts by volume of additive | Film Builder Assistant | SCO 10 | SCO 10 | SCO 10 | Sulfonated oleyl alcohol 40 | SCO 40 | SCO 40 | SCO 40 | SCO 40 | |
| | | NaDOS 10 | NaDOS 10 | NaDOS 10 | NaDOS 10 | NaDOS 10 | NaDOS 10 | NaDOS 10 | NaDOS 10 | |
| | Etching promoter | Polyethylene glycol 600 50 | Polypropylene glycol 1000 50 | Polypropylene and polyethylene glycol block copolymer 50 | BC 50 | BC 50 | BC 50 | BC 50 | BC 50 | |
| | Etching (°C) temperature | 35 | 35 | 35 | 35 | 35 | 35 | 30 | 40 | 35 |
| | Etching time for 100μ nickel plating (min) | 18 | 30 | 15 | 20 | 18 | 25 | 28 | 17 | 5 |
| | One side etching for 100μ depth, μ | 15 | 15 | 10 | 5 | 15 | 5 | 5 | 10 | 100 |

What is claimed is:

1. An etching composition for nickel screen rolls or plates which comprises 5 - 15% by volume of 62% $HNO_3$ and 15 - 25% by volume of 35% hydrogen peroxide and 3 - 6% by volume of additives and a balance of water; said additives comprising 40 - 60% by volume of a petroleum hydrocarbon solvent which is incompatible with water, 15 - 25% by volume of sulfate salt of glyceride of fatty acid consisting essentially of 18 carbon atoms, sulfate salt of fatty acid consisting essentially of 18 carbon atoms, or sulfate salt of fatty alcohol consisting essentially of 18 carbon atoms, 4 - 6% by volume of a first etching promoter selected from the group consisting of dialkyl sulfosuccinate salt, sulfonate salt of $C_{10}$-$C_{12}$ petroleum hydrocarbon, sulfonate salt or sulfate salt of $C_{10}$-$C_{12}$ fatty acid, and sulfonate salt or sulfate salt of $C_{10}$-$C_{12}$ fatty alcohol and 20 - 30% by volume of a second etching promoter selected from the group consisting of butyl carbitol, polypropylene glycol, polyethylene glycol, a mixture thereof and a block copolymer thereof.

* * * * *